US010859085B2

(12) United States Patent
Yu et al.

(10) Patent No.: US 10,859,085 B2
(45) Date of Patent: Dec. 8, 2020

(54) MAGNETIC PUMP, WATER PUMPING DEVICE AND METHOD FOR USING THE MAGNETIC PUMP

(71) Applicant: GUANGDONG BOYU GROUP CO., LTD, Chaozhou (CN)

(72) Inventors: Youkai Yu, Chaozhou (CN); Bingyan Yu, Chaozhou (CN); Jianqin Yu, Chaozhou (CN)

(73) Assignee: GUANGDONG BOYU GROUP CO., LTD., Chaozhou (CN)

( * ) Notice: Subject to any disclaimer, the term of this patent is extended or adjusted under 35 U.S.C. 154(b) by 115 days.

(21) Appl. No.: 16/247,754

(22) Filed: Jan. 15, 2019

(65) Prior Publication Data

US 2020/0166037 A1 May 28, 2020

(30) Foreign Application Priority Data

Nov. 23, 2018 (CN) ..... 2018 2 1951380 U
Dec. 3, 2018 (CN) ..... 2018 1 1466805
Dec. 3, 2018 (CN) ..... 2018 2 2021300 U

(51) Int. Cl.

| | |
|---|---|
| ***F04D 13/02*** | (2006.01) |
| *F04D 29/40* | (2006.01) |
| *F04D 29/60* | (2006.01) |
| *F04D 13/08* | (2006.01) |

(52) U.S. Cl.

CPC ..... *F04D 13/027* (2013.01); *F04D 13/024* (2013.01); *F04D 13/086* (2013.01); *F04D 29/40* (2013.01); *F04D 29/406* (2013.01); *F04D 29/60* (2013.01); *F04D 29/606* (2013.01)

(58) Field of Classification Search

CPC .... F04D 13/027; F04D 13/024; F04D 13/086; F04D 29/40; F04D 29/406; F04D 29/606; F04D 29/60

USPC ..... 417/420

See application file for complete search history.

(56) References Cited

U.S. PATENT DOCUMENTS 4,408,891 A * 10/1983 Schirk ..... G03D 3/04 366/137
4,612,947 A * 9/1986 Duncan ..... A47L 15/4202 134/104.1
8,214,937 B2 * 7/2012 Lawyer ..... A61H 33/6063 4/541.1

(Continued)

*Primary Examiner* — Connor J Tremarche

(74) *Attorney, Agent, or Firm* — McNees Wallace & Nurick LLC

(57) ABSTRACT

Provided is a magnetic pump that includes an isolation hood, an electric motor, a first rotating magnet, a second rotating magnet, and a pump body. The isolation hood includes a first mounting position and a second mounting position which are isolated and sealed from each other. The electric motor and the second rotating magnet are both disposed on the first mounting position, while the first rotating magnet and the pump body are both disposed on the second mounting position. Further provided is a water pumping device that includes a magnetic pump and a box filled with a liquid to be transported. The magnetic pump is arranged on the box, the magnetic pump being the magnetic pump described above. Further provided is a method for using a magnetic pump, which can prevent contact between a power cable of the electric motor and the liquid inside the box.

10 Claims, 6 Drawing Sheets

(56) References Cited

U.S. PATENT DOCUMENTS

2009/0226335 A1* 9/2009 Lee ..... F04D 13/064
417/423.3

* cited by examiner

MAGNETIC PUMP, WATER PUMPING DEVICE AND METHOD FOR USING THE MAGNETIC PUMP

CROSS-REFERENCES TO RELATED APPLICATIONS

This application claims priority to a Chinese patent application publication No. 201811466805.X filed on Dec. 3, 2018, disclosure of which is incorporated herein by reference in its entirety.

TECHNICAL FIELD

The present disclosure relates to the technical field of pumps, and, in particular, to a magnetic pump that delivers a fluid, a water pumping device that includes this magnetic pump, and a method for using this magnetic pump.

BACKGROUND

A pump is a machine that changes the pressure of a fluid inside a volume or that delivers a fluid. It is an energy conversion device controlled by a prime mover to drive a medium into motion thus converting energy output from the prime mover into pressure energy of the medium. Pumps come in various types, and are greatly useful in all kinds of industries and have found widespread application. A magnetic pump is composed of the following three parts: a pump, a magnetic actuator, and an electric motor. Magnetic pumps have been widely used in various water pumping devices such as a drinking fountain, a coffee maker, an air-conditioner, or a water heater. In the related art, however, since an isolation hood is disposed inside the magnetic pump, an extra waterproof device needs to be configured to waterproof the electric motor when this magnetic pump is mounted onto the water pumping device. Such a magnetic pump is complicated in structure, hence a poor waterproof performance and inconvenience of use.

SUMMARY

An object of the present disclosure is to provide a magnetic pump, which has a good waterproof performance.

Another object of the present disclosure is to provide a magnetic pump which may generate power during operation.

Yet another object of the present disclosure is to provide a water pumping device, which has a good waterproof performance and can prevent a power cable from entering the inside of a box.

Still another object of the present disclosure is to provide a method for using a magnetic pump, which has a high safety performance and can generate power automatically.

To achieve these objects, the present disclosure adopts the following technical solution.

According to one aspect, the present disclosure provides a magnetic pump, including an isolation hood, an electric motor, a first rotating magnet, a second rotating magnet and a pump body, the isolation hood is provided with a first mounting position and a second mounting position which are isolated and sealed from each other, the electric motor and the second rotating magnet are disposed on the first mounting position, the first rotating magnet and the pump body are disposed on the second mounting position As an exemplary solution of the magnetic pump, the isolation hood is formed on at least one of a side wall and a bottom of a box containing a liquid to be transported, and the first mounting position and the second mounting position are located outside and inside the box, respectively.

As an exemplary solution of the magnetic pump, the isolation hood includes a side plate and an end plate disposed at an end of the side plate, the side plate and the end plate enclosing to define a mounting cavity, which is located in the first mounting position.

As an exemplary solution of the magnetic pump, the second rotating magnet is coupled to a spindle of the electric motor.

As an exemplary solution of the magnetic pump, the pump body comprises a rotor assembly, a pump housing and a pump cover disposed at an end of the pump housing, the rotor assembly includes a pump shaft and an impeller disposed on the pump shaft, and the impeller is disposed inside the pump housing, the pump housing is provided with a liquid inlet, the pump cover is provided with a first liquid outlet in communication with the liquid inlet, the first rotating magnet is disposed on the pump shaft.

As an exemplary solution of the magnetic pump, there is provided a fixing base on the second mounting position, and in the fixing base is provided a pump shaft mounting seat configured for mounting the pump shaft, where one end of the pump shaft is disposed in the pump shaft mounting seat, and the other end extends in a direction toward the pump cover.

As an exemplary solution of the magnetic pump, the magnetic pump further includes an inductive power generation assembly, the inductive power generation assembly includes an induction iron core and a power generation induction coil wound around the induction iron core, when the electric motor rotates, the power generation induction coil is operative to generate power by cutting magnetic field lines of the first rotating magnet or of the second rotating magnet.

As an exemplary solution of the magnetic pump, there is disposed in the fixing base a power generation assembly mounting seat configured for mounting the inductive power generation assembly.

As an exemplary solution of the magnetic pump, the power generation assembly mounting seat is disposed to surround the pump shaft mounting seat.

As an exemplary solution of the magnetic pump, the end plate is concavely provided with a first mounting groove that faces toward the second mounting position and that is configured for mounting the fixing base, a second mounting groove is defined between a groove wall of the first mounting groove and the side plate, and the second rotating magnet is disposed in the second mounting groove.

As an exemplary solution of the magnetic pump, the magnetic pump further includes an flow guide hood disposed above the pump cover, the flow guide hood is provided with a second liquid inlet in communication with the first liquid inlet.

As an exemplary solution of the magnetic pump, the magnetic pump further includes a base, and the electric motor is disposed on the base.

According to another aspect, a water pumping device is further provided, including a magnetic pump and a box filled with a liquid to be transported, where the magnetic pump is arranged on the box, the magnetic pump being the above-described magnetic pump.

According to yet another aspect, a method of using a magnetic pump is further provided. The method includes providing an isolation hood and an inductive power generation assembly; arranging an electric motor and a second rotating magnet of the magnetic pump both on the first mounting position on the isolation hood, and the inductive power generation assembly as well as the first rotating magnet and the pump body of the magnetic pump on the second mounting position of the isolation hood; driving the electric motor to rotate the second rotating magnet, enabling the second rotating magnet to drive the first rotating magnet to rotate synchronously with the second rotating magnet by means of a magnetic force, such that the power generation induction coil generates power by cutting magnetic field lines of the first rotating magnet or the second rotating magnet.

The present disclosure has the following beneficial effects. In the present disclosure, by configuring the first mounting position and the second mounting position to be sealed from each other, the electric motor and the pump body are fully water isolated thus preventing the liquid from leaking onto the electric motor. Furthermore, in actual use the power cable on the electric motor can be prevented from contacting the liquid to be transported, thereby improving the safety of the magnetic pump. The electric motor and the second rotating magnet are disposed on the first mounting position outside the box while the first rotating magnet and the pump body are disposed on the second mounting position inside the box, which means the electric motor and the second rotating magnet are fully isolated outside the box, which prevents the liquid inside the box from leaking onto the electric motor from the pump body, and the power cable of the electric motor from reaching the inside of the box. Through this design, an absolute waterproof feature of the electric motor in the magnetic pump is ensured and so the safety performance of the magnetic pump is improved.

BRIEF DESCRIPTION OF DRAWINGS

The present disclosure will be described in further detail in conjunction with the drawings and embodiments.

In the drawings.

Figure 1:
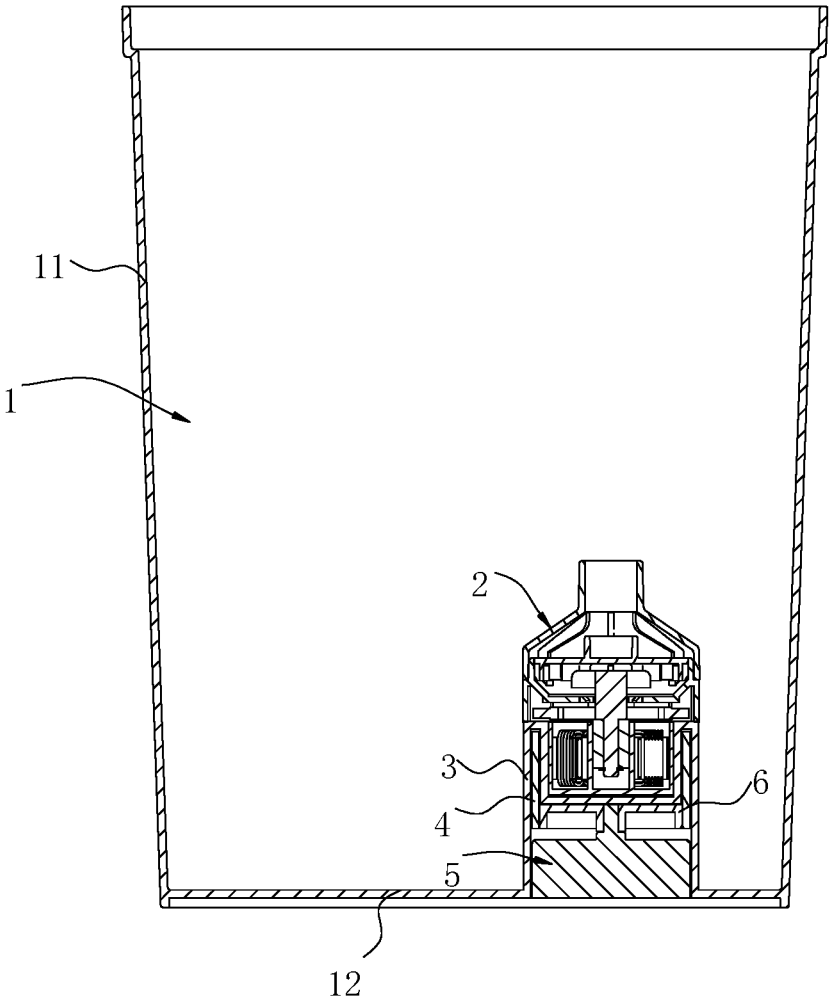
FIG. 1 is a diagram of a mounting structure of a magnetic pump and a box.
Figure 2:
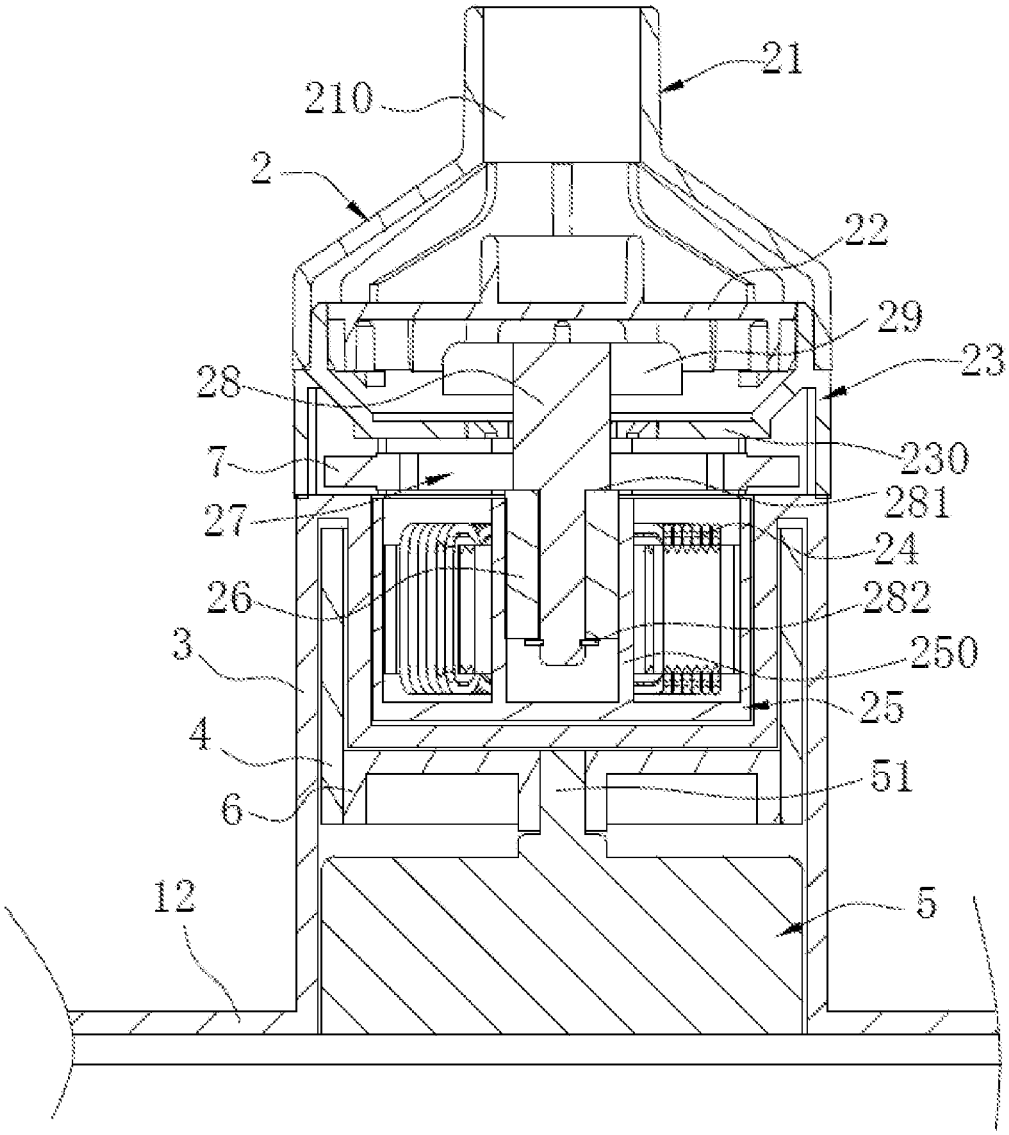
FIG. 2 is a partial schematic diagram of a mounting structure of a magnetic pump and a box.

1: Box; 11: Side Wall; 12: Bottom;

2: Pump Body; 21: Flow Guide Hood; 210: Second Liquid Outlet; 211: Liquid Outlet Section; 212: Flow Guide Hood Body; 22: Pump Cover; 220: First Outlet; 23: Pump Housing; 230: Isolation Plate; 231: Liquid Passing Through Opening; 232: Liquid Inlet; 24: Inductive Power Generation Assembly; 240: Induction Iron Core; 241: Power Generation Induction Coil; 242: Avoiding Hole; 25: Fixing Base; 250: Pump Shaft Mounting Seat; 251: Power Generation Assembly Mounting Seat; 26: Bearing Bush; 27: Mounting Bracket; 270: Connecting Plate; 271: Mounting Plate; 28: Pump Shaft; 280: Stop Slot; 281: Stop Step; 282: Stop Clasp; 29: Impeller

3: Isolation Hood;

4: Second Rotating Magnet;

5: Electric Motor; 50: Spindle;

6: Turntable; 60: Through-hole;

7: First Rotating Magnet.

DETAILED DESCRIPTION

To make clearer problems to be solved, adopted solutions, and effects that can be achieved of the present disclosure, the solution of the present disclosure is further described in conjunction with accompanying drawings and embodiments. The embodiments described below are part, rather than all, of embodiments of the present disclosure. Based on the embodiments of the present disclosure, all other embodiments obtained by those skilled in the art shall fall in the scope of the present disclosure on the premise that no creative work is done.

In the description of the present disclosure, unless otherwise expressly specified and defined, the term "connected to each other", "connected" or "fixed" is to be construed in a broad sense, for example, as permanently connected, detachably connected, or integrated; mechanically connected or electrically connected; directly connected to each other or indirectly connected to each other via an intermediary; or internally connected or interactional between two components. For those of ordinary skill in the art, the above terms can be construed depending on specific contexts in the present disclosure.

In the present disclosure, unless otherwise expressly specified and defined, when a first feature is described as "above" or "below" a second feature, the first feature and the second feature may be in direct contact, or be in contact via another feature between the two features. Moreover, when the first feature is described as "on", "above" or "over" the second feature, the first feature is directly on, above or over the second feature or the first feature is obliquely on, above or over the second feature, or the first feature is at a higher level than the second feature. When the first feature is described as "under", "below" or "underneath" the second feature, the first feature is right under, below or underneath the second feature or the first feature is obliquely under, below or underneath the second feature, or the first feature is at a lower level than the second feature.

As shown in FIGS. 1 to 9, the present disclosure provides a magnetic pump, including an isolation hood 3, an electric motor 5, a first rotating magnet 7, a second rotating magnet 4 and a pump body 2, the isolation hood 3 is provided with a first mounting position and a second mounting position which are isolated and sealed from each other, the electric motor 5 and the second rotating magnet 4 are disposed on the first mounting position, the first rotating magnet 7 and the pump body 2 are disposed on the second mounting position.

By configuring the first mounting position and the second mounting position sealed from each other, the electric motor 5 and the pump body 2 are fully water isolated, which prevents the liquid from leaking onto the electric motor 5, and prevents the power cable on the electric motor from contacting the liquid to be transported, improving the safety of the magnetic pump.

Specifically, the isolation hood 3 is formed on at least one of a side wall 11 and a bottom 12 of a box 1 containing a liquid to be transported, and the first mounting position and the second mounting position are located outside and inside the box respectively. The isolation hood 3 is formed on the side wall 11 or the bottom 12 of the box 1 filled with liquid to be transported, so that the isolation hood 3 and the side wall 11 or the bottom 12 of the box 1 are integrally formed, ensuring that the first mounting position and the second mounting position are isolated and sealed from each other. The electric motor 5 and the second rotating magnet 4 are disposed on the first mounting position outside the box 1, and the first rotating magnet 7 and the pump body 2 are disposed on the second mounting position inside the box 1, so that the electric motor 5 and the second rotating magnet 4 are fully isolated outside the box 1, which prevents the liquid in the box 1 from leaking onto the electric motor 5 from the pump body 2, and prevents the power cable of the electric motor 5 from reaching the inside of the box 1. Through this design, an absolute waterproof feature of the electric motor 5 in the magnetic pump is ensured and the safety performance of the magnetic pump is improved.

In this embodiment, as illustrated in FIG. 1, the isolation hood 3 is formed by recessing of the bottom 12 outside the box 1.Through this design, the electric motor 5 can be directly disposed on a platform of the box 1, which facilitates the disposition of the electric motor 5, and also facilitates the carry, displacement, and maintenance of the box 1, as well as replacement of the liquid inside the box 1.

To facilitate disposing the electric motor 5, the magnetic pump further include a base (not shown in the figure), and the electric motor 5 is disposed on the base. Typically, the isolation hood 3 is formed by recessing of the bottom 12 outside the box 1. In this case, the base is disposed on a plane on which a water pumping device is placed and then the base is used to support the electric motor 5, then when the box 1 is lifted up, the electric motor 5 and the second rotating magnet 4 would be automatically disengaged from the box 1, which facilitates the carry, displacement, and maintenance of the box 1, as well as replacement of the liquid inside the box 1.But in other embodiments, the base may be flexibly disposed on a corresponding position of the box 1 according to the electric motor 5.

The isolation hood 3 includes a side plate and an end plate disposed at an end of the side plate, the side plate and the end plate enclosing to define a mounting cavity, which is located in the first mounting position. Typically, to improve the overall aesthetics of the box 1, when the electric motor 5 is mounted in the mounting cavity, the electric motor 5 does not protrude out of an outer wall of the box 1.In the case where the isolation hood 3 is formed by recessing the bottom 12 outside the box 1, by disposing the electric motor 5 to not protrude out of the outer wall of the box 1, the box 1 can be placed smoothly on the plane.

In one embodiment, the second rotating magnet 4 is coupled to a spindle 50 of the electric motor 5. When the electric motor 5 rotates, the second rotating magnet 4 is driven to rotate via the spindle. In the specific implementation, the second rotating magnet 4 is directly connected to the spindle 50 of the electric motor 5, and may also be indirectly connected to the spindle 50 of the electric motor 5. In this embodiment, the second rotating magnet 4 is connected to the spindle 50 of the electric motor 5 by a turntable 6, such that when the electric motor 5 rotates, the spindle 50 of the electric motor 5 drives the turntable 6 to rotate, then the second rotating magnet 4 rotates, then the first rotating magnet 7 and the second rotating magnet 4 rotate. Typically, the turntable 6 is disposed in the mounting cavity, which prevents deviation of the turntable 6 when the turntable 6 rotates.

Specifically, the center of the turntable 6 define a through hole 60 that passes through the turntable 6, and the spindle 50 of the electric motor 5 is disposed in the through hole 60. In other embodiments, the second rotating magnet 4 may also be connected to the spindle 50 of the electric motor 5 by other components, where the nature of the connection of the second rotating magnet 4 and the spindle 50 of the electric motor 5 is not specifically limited.

In this embodiment, the pump body 2 includes a pump shaft 28, a pump housing 23, and a pump cover 22 disposed at an end of the pump housing 23, a rotor assembly includes the pump shaft 28 and an impeller 29 disposed on the pump shaft 28, and the impeller 29 is disposed inside the pump housing 23, the pump housing 23 is provided with a liquid inlet 232, the pump cover 22 is provided with a first liquid outlet 220 connected to the liquid inlet 232, the first rotating magnet 7 is disposed on the pump shaft 28.The rotation of the electric motor 5 drives the second rotating magnet 4 to rotate, under the action of a magnetic force, the first rotating magnet 7 and the second rotating magnet 4 rotate synchronously. Since the impeller 29 is disposed on the pump shaft 28, and the first rotating magnet 7 is connected to the pump shaft 28, the pump shaft 28 and the impeller 29 are driven to rotate synchronously by the first rotating magnet 7, so that the liquid in the box 1 enters the inside of the pump housing 23 by the liquid inlet 232 and flows out by the first liquid outlet 220, implementing the function of fluid delivery.

Specifically, the pump housing 23 is provided with one or more liquid inlets 232. When the pump housing 23 is provided with more than two liquid inlets 232, the liquid inlets 232 are disposed at intervals. The pump cover 22 is provided with one or more than two the first liquid outlets 220. When the pump cover 22 is provided with more than two the first liquid outlets 220, the first liquid outlets 220 are disposed at intervals.

To facilitate mounting of the first rotating magnet 7, the pump shaft 28 is provided with a mounting bracket 27 for mounting the first rotating magnet 7. The mounting bracket 27 is located between the impeller 29 and the isolation hood 3. The disposition of the mounting bracket 27 is mainly for convenience of mounting the first rotating magnet 7, and disposing the mounting bracket 27 between the impeller 29 and the isolation hood 3 is for bringing the first rotating magnet 7 close to the second rotating magnet 4, ensuring that a sufficiently large magnetic force is provided between the first rotating magnet 7 and the second rotating magnet 4.

Specifically, a pump house is provided inside the pump housing 23, the liquid inlet 232 is connected to the first liquid outlets 220 by the pump housing 23.

The pump house is provided with an isolation plate 230 connected to the pump housing 23, the isolation plate 230 is located between the mounting bracket 27 and the impeller 29, and the pump shaft 28 extends toward the pump cover 22 penetrating the isolation plate 230. A liquid passing through opening 231 respectively connected the liquid inlet 232 and the first liquid outlets 220 are disposed between the pump shaft 28 and the isolation plate 230. In the actual use of the magnetic pump, the liquid in the box 1 sequentially passes through the liquid inlet 232 and the liquid passing through opening 231, and flows out of the first liquid outlets 220.

Typically, the mounting bracket 27 includes a connecting plate 270 and a mounting plate 271. The mounting plate 271 is connected to the pump shaft 28 by the mounting bracket 27. The first rotating magnet 7 is mounted on the mounting plate 271.

In one embodiment, the first rotating magnet 7 is disposed on a side of the mounting plate 271 away from the isolation hood 3.

In another embodiment, the first rotating magnet can be mounted on an upper surface or a lower surface of the mounting plate 271.

Figure 3:
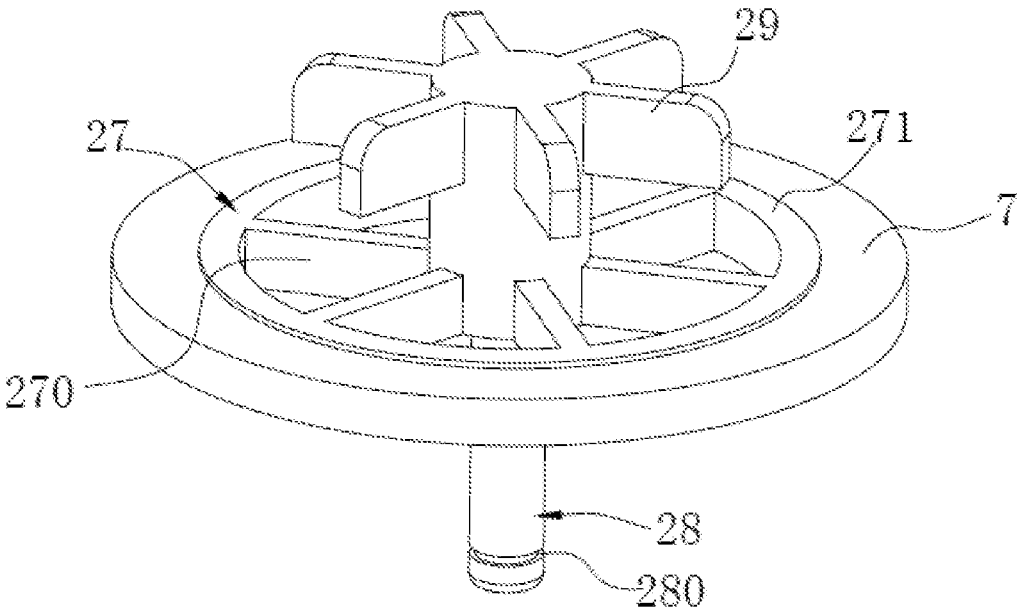
FIG. 3 is a diagram of a mounting structure of a pump shaft and a first rotating magnet.
Figure 4:
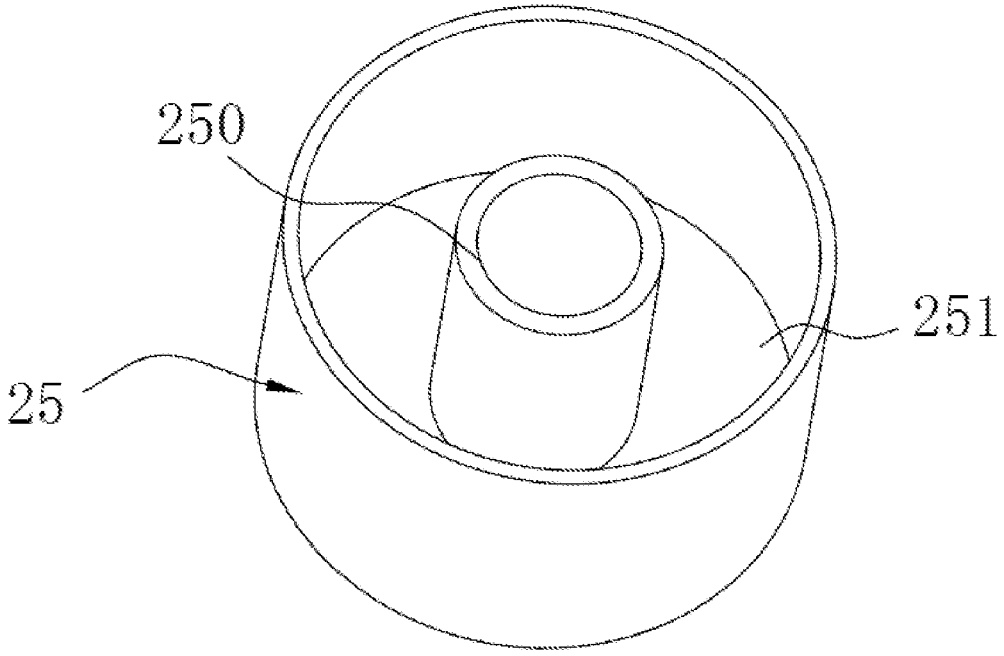
FIG. 4 is structural diagram of a fixing base.
Figure 5:
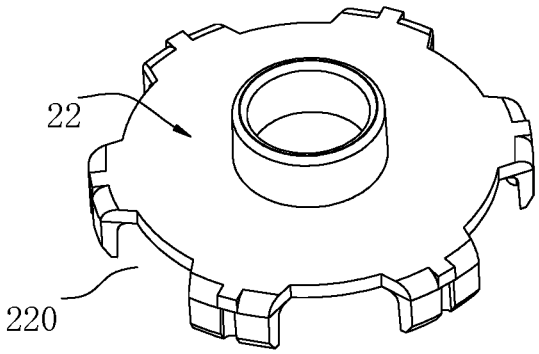
FIG. 5 is structural diagram of a pump cover.
Figure 6:
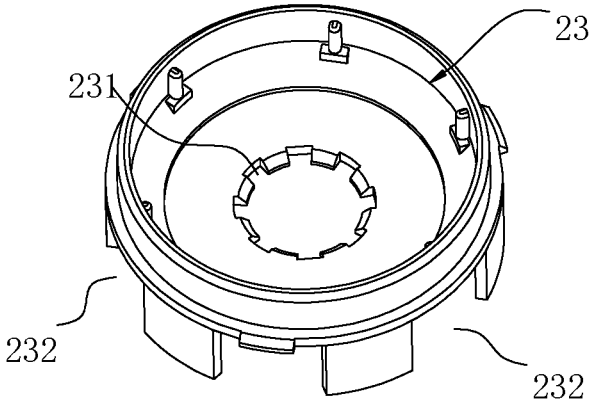
FIG. 6 is structural diagram of a pump housing.
Figure 7:
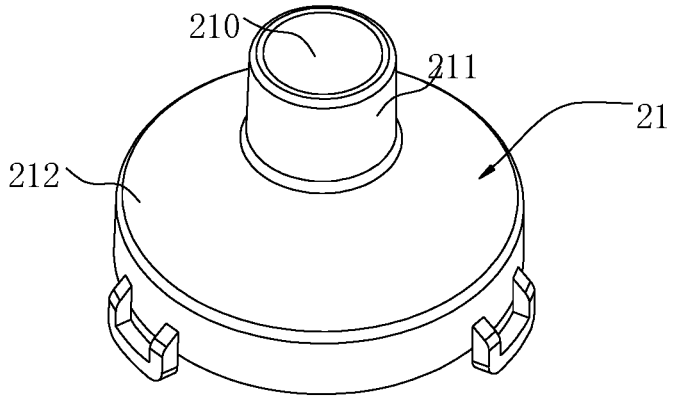
FIG. 7 is structural diagram of an flow guide hood.
Figure 8:
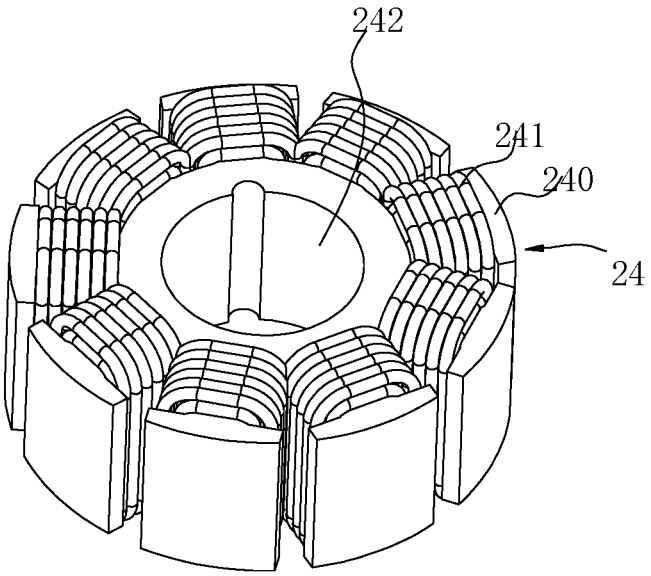
FIG. 8 is structural diagram of an inductive power generation assembly.
Figure 9:
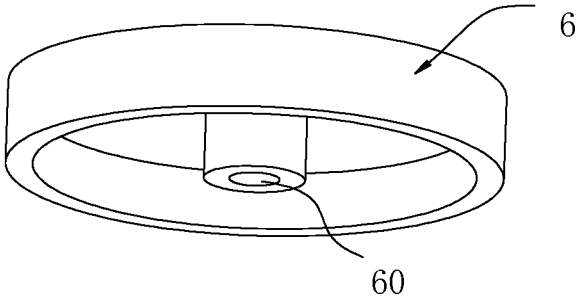
FIG. 9 is structural diagram of a turntable.

As a typical implementation, as illustrated in FIG. 3, the first rotating magnet 7 is configured to enclose an outer circumference of the mounting plate 271. Specifically, the first rotating magnet 7 is a ring structure.

In other embodiments, the first rotating magnet 7 may also be disposed inside the mounting plate 271.

One, two, three, four or five first rotating magnet 7 and second rotating magnet 4 may be disposed. The number of the first rotating magnets 7 and the second rotating magnets 4 are not limited. In a specific implementation, the number of the first rotating magnets 7 and that of the second rotating magnets 4 may be disposed respectively according to needs.

It is to be noted that a specific shape of the first rotating magnets 7 may be flexibly configured according to actual needs, such as plate-shaped, ring-shaped or other irregular shapes. Here, the specific shape of the first rotating magnets 7 is not limited.

In this embodiment, the second mounting position is provided with a fixing base 25, the fixing base 25 is provided with a pump shaft mounting seat 250 for mounting the pump shaft 28, one end of the pump shaft 28 is disposed in the pump shaft mounting seat 250, the other end extends in a direction toward the pump cover 22. Through this design, it is convenient for mounting the pump shaft 28.

Typically, a centerline of the pump shaft 28 coincides with a centerline of the spindle 50 of the electric motor 5. However, in other embodiments, the centerline of the pump shaft 28 may be configured to deviate from the centerline of the spindle 50 of the electric motor 5. Here, the position of the pump shaft 28 and the spindle 50 of the electric motor 5 is not limited.

To reduce friction between the pump shaft 28 and the pump shaft mounting seat 250, one end of the pump shaft 28 disposed in the pump shaft mounting seat 250 is provided with a bearing bush 26, which is disposed at the outer circumference of the pump shaft 28.

The bearing bush 26 is provided with a mounting hole fitted with the pump shaft 28. The bearing bush 26 is stopped on the pump shaft 28 by a stopper component. Specifically, the stop component includes a stop step 281 and a stop clasp 282, a bearing bush mounting position is defined by the stop step 281 and the stop clasp 282, so that the bearing bush 26 is stopped on the pump shaft 28 to avoid falling off. The pump shaft 28 is provided with a stop slot 280 for mounting the stop clasp, the stop clasp 282 is coordinatively insertable into the stop slot 280 and protrudes out of the outer circumference of the pump shaft 28.

As a typical technical solution, the magnetic pump further includes an inductive power generation assembly 24, the inductive power generation assembly 24 including an induction iron core 240 and a power generation induction coil 241 wound around the induction iron core 240, when the electric motor 5 rotates, the power generation induction coil 241 is operative to generate power by cutting magnetic field lines of the first rotating magnet 7 or the second rotating magnet 4.

The electric motor 5 drives the second rotating magnet 4 to rotate, when the second rotating magnet 4 rotates, the power generation induction coil 241 generates power by cutting the magnetic field lines of the second rotating magnet 4 or the first rotating magnet 7 and supplies power to other devices.

Specifically, the inductive power generation assembly 24 may be disposed on the second mounting position, or may also be disposed on the first mounting position.

Furthermore, the inductive power generation assembly 24 may be disposed on the first rotating magnet 7, under the first rotating magnet 7 or on a side of the first rotating magnet 7. The inductive power generation assembly 24 may be disposed on the second rotating magnet 4, under the second rotating magnet 4 or on a side of the second rotating magnet 4.

In this embodiment, the inductive power generation assembly 24 may be disposed in the second mounting position. Specifically, a power generation assembly mounting seat 251 is disposed to surround the pump shaft mounting seat 250. Through this design, the magnetic field lines can be cut by the power generation induction coil 241 at any angle at which the second rotating magnet 4 rotates, thereby achieving uninterrupted power generation.

Typically, the pump shaft mounting seat 250 is disposed at the center of the fixing base 25, so that the pump shaft 28 is mounted in the center of the fixing base, thus optimizing the internal structure the pump body 2.

Specifically, the power generation assembly mounting seat 251 is a holding slot formed by enclosing of an outer wall of the pump shaft mounting seat 250 and an inner wall of the fixing base, when the power generation induction coil 241 is mounted in the holding slot, the power generation induction coil 241 does not protrude out of an open end of the holding slot, so that the inductive power generation assembly 24 is wholly held in the holding slot.

Furthermore, the induction iron core 240 is provided with an avoiding hole 242 for avoiding the pump shaft mounting seat 250. In actual use, the power generation induction coil 241 is put on the outer circumference of pump shaft mounting seat 250 by the avoiding hole 242.

Furthermore, the end plate is concavely provided with a first mounting groove that faces toward the second mounting position and that is configured for mounting the fixing base 25, a second mounting groove is defined between a recess wall of the first mounting groove and the side plate, and the second rotating magnet 4 is disposed in the second mounting groove.

As another typical technical solution, the second rotating magnet 4 is a cylindrical shape, the second mounting groove is adapted to the second rotating magnet 4, so that the second rotating magnet 4 is disposed outside the recess wall of the first mounting groove, which facilitates the mounting of the second rotating magnet 4.

Specifically, an inner side of the second rotating magnet 4 is connected to an outer surface of the turntable 6.

In this embodiment, the magnetic pump further includes an flow guide hood 21 disposed above the pump cover 22, the flow guide hood 21 is provided with a second liquid outlet 210 in communication with the first liquid outlet 220.

Specifically, the flow guide hood 21 includes an flow guide hood body 212 and a liquid outlet section 211 disposed at an end of the flow guide hood body 212 away from the pump cover 22. An end of the flow guide hood body 212 away from liquid outlet section 211 is connected to the pump housing 23, the second liquid outlet 210 is disposed on the liquid outlet section 211.

Furthermore, an outer wall of the pump housing 23 is provided with a positioning step, an end of the flow guide hood body 212 away from the second liquid outlet 210 abuts against the positioning step, which facilitates mounting the flow guide hood 21.

Through the disposition of the flow guide hood 21, the liquid in all first liquid outlets 220 on the pump cover 22 flows out of the second liquid outlet 210, thus improving the speed of the liquid passing through the second liquid outlet 210.

In this embodiment, a water pumping device is further provided, including a magnetic pump and a box 1 containing a liquid to be transported. The magnetic pump is arranged on the box, the magnetic pump being the magnetic pump in any of the embodiments described above. The magnetic pump of this water pumping device has a good waterproof performance, and can fully isolate the electric motor 5 of the magnetic pump from the water inside the box 1, and can prevent the power cable of the electric motor 5 from reaching the inside of the box 1 thereby reducing the possibility of electric leakage of the electric motor 5.

Specifically, the water pumping device may be a pet aquarium, a pet drinking fountain, a water heater, or a coffee maker. However, the type of the water pumping device is not specifically limited herein.

In the present disclosure, there is further provided a method for using a magnetic pump of any one of structures described above. The method includes the following operations. First an isolation hood 3 and an inductive power generation assembly 24 are provided, then an electric motor 5 of the magnetic pump and a second rotating magnet 4 are both disposed on a first mounting position on the isolation hood 3, the inductive power generation assembly 24 as well as a first rotating magnet 7 and a pump body 2 of the magnetic pump are disposed on a second mounting position of the isolation hood 3, then the electric motor is driven to rotate the second rotating magnet 4, the second rotating magnet 4 drives the first rotating magnet 7 to rotate synchronously with the second rotating magnet 4 by a magnetic force, then a power generation induction coil 21 generates power by cutting a magnetic field lines of the first rotating magnet 7 or the second rotating magnet 4. This method can avoid contact between the power cable of the electric motor 5 and the liquid inside the box 1, and so has a high safety performance. The method also can generate power automatically during the operation of electric motor 5 and then supply power to other devices.

In the description of the present disclosure, it is to be understood that the orientational or positional relationships indicated by terms "above", "below", "right" and the like are based on the orientational or positional relationships illustrated in the drawings, merely for facilitating description of the present disclosure and simplifying the operation, and these relationships do not indicate or imply that the referenced device or element has a specific orientation and is constructed and operated in a specific orientation, and thus it is not to be construed as limiting the present disclosure. The terms "first" and "second" in the specification are only used for descriptive purposes and have no special meanings.

In the description of the specification, the description of reference terms "one embodiment" or "example" means that specific characteristics, structures, materials or features described in connection with the embodiment are included in at least one embodiment or example of the present disclosure. In the specification, the schematic representation of the above terms does not necessarily refer to the same embodiment or example.

Moreover, it will be understood that although this specification is described in terms of the embodiments, not every embodiment includes only one independent solution. Such description mode of the specification is merely for the sake of clarity, and those skilled in the art should regard the specification as an integrity. The technical solutions in the embodiments may also be appropriately combined to form other embodiments which will be understood by those skilled in the art.

The principle of the present disclosure is described above in conjunction with the embodiments. The description is merely used for explaining the principle of the present disclosure, and is by no means to be construed as limitations to the scope of protection present disclosure. Based on the explanation herein, other embodiments of the present disclosure obtained by those skilled in the art shall fall in the scope of the present disclosure providing that no creative work is involved.

What is claimed is:

1. A magnetic pump, comprising: an isolation hood, an electric motor, a first rotating magnet, a second rotating magnet, and a pump body, and an inductive power generation assembly, wherein the isolation hood comprises a first mounting position and a second mounting position which are isolated and sealed from each other, the electric motor and the second rotating magnet are both disposed on the first mounting position, the first rotating magnet and the pump body are both disposed on the second mounting position;

wherein the isolation hood comprises a side plate and an end plate disposed at an end of the side plate, the side plate and the end plate enclosing with each other to define a mounting cavity, which is located in the first mounting position;

wherein the pump body comprises a rotor assembly, a pump housing, and a pump cover disposed at an end of the pump housing, wherein the rotor assembly comprises a pump shaft and an impeller disposed on the pump shaft, and the impeller is disposed inside the pump housing, the pump housing is provided with a liquid inlet, the pump cover is provided with a first liquid outlet in communication with the liquid inlet, the first rotating magnet is disposed on the pump shaft;

wherein there is provided a fixing base on the second mounting position, and in the fixing base is provided a pump shaft mounting seat configured for mounting the pump shaft, wherein one end of the pump shaft is disposed in the pump shaft mounting seat, and the other end extends in a direction toward the pump cover;

wherein the inductive power generation assembly comprises an induction iron core and a power generation induction coil wound around the induction iron core, wherein when the electric motor rotates, the power generation induction coil is operative to generate power by cutting magnetic field lines of the first rotating magnet or of the second rotating magnet; and wherein there is disposed in the fixing base a power generation assembly mounting seat configured for mounting the inductive power generation assembly.

2. The magnetic pump according to claim 1, wherein the isolation hood is formed on at least one of a side wall and a bottom of a box containing a liquid to be transported, and wherein the first mounting position is located outside the box and the second mounting position is located inside the box.

3. The magnetic pump according to claim 1, wherein the second rotating magnet is coupled to a spindle of the electric motor.

4. The magnetic pump according to claim 1, wherein the power generation assembly mounting seat is disposed to surround the pump shaft mounting seat.

5. The magnetic pump according to claim 4, wherein the end plate is concavely provided with a first mounting groove that faces toward the second mounting position and that is configured for mounting the fixing base, a second mounting groove is defined between a groove wall of the first mounting groove and the side plate, and the second rotating magnet is disposed in the second mounting groove.

6. The magnetic pump according to claim 1, further comprising a flow guide hood being disposed over and covering the pump cover, wherein the flow guide hood is provided with a second liquid outlet in communication with the first liquid outlet.

7. The magnetic pump according to claim 1, further comprising a base, on which the electric motor is disposed.

8. A water pumping device, comprising a magnetic pump and a box filled with a liquid to be transported, wherein the magnetic pump is arranged on the box, the magnetic pump comprising an isolation hood, an electric motor, a first rotating magnet, a second rotating magnet, and a pump body, wherein the isolation hood comprises a first mounting position and a second mounting position which are isolated and sealed from each other, the electric motor and the second rotating magnet are both disposed on the first mounting position, and the first rotating magnet and the pump body are both disposed on the second mounting position;

wherein the isolation hood comprises a side plate and an end plate disposed at an end of the side plate, the side plate and the end plate enclosing with each other to define a mounting cavity, which is located in the first mounting position;

wherein the pump body comprises a rotor assembly, a pump housing, and a pump cover disposed at an end of the pump housing, wherein the rotor assembly comprises a pump shaft and an impeller disposed on the pump shaft, and the impeller is disposed inside the pump housing, the pump housing is provided with a liquid inlet, the pump cover is provided with a first liquid outlet in communication with the liquid inlet, the first rotating magnet is disposed on the pump shaft;

wherein there is provided a fixing base on the second mounting position, and in the fixing base is provided a pump shaft mounting seat configured for mounting the pump shaft, wherein one end of the pump shaft is disposed in the pump shaft mounting seat, and the other end extends in a direction toward the pump cover;

wherein the magnetic pump further comprises an inductive power generation assembly, the inductive power generation assembly comprising an inductive iron core and a power generation induction coil wound around the induction iron core, wherein when the electric motor rotates, the power generation induction coil is operative to generate power a cutting magnetic field lines of the first rotating magnet or of the second rotating magnet; and wherein there is disposed in the fixing base a power generation assembly mounting seat configured for mounting the inductive power generation assembly.

9. A method of using a magnetic pump that comprises an isolation hood, an electric motor, a first rotating magnet, a second rotating magnet, and a pump body, wherein the isolation hood comprises a first mounting position and a second mounting position which are isolated and sealed from each other, the electric motor and the second rotating magnet are both disposed on the first mounting position, and the first rotating magnet and the pump body are both disposed on the second mounting position, the method comprising:

providing the isolation hood and an inductive power generation assembly;

arranging the electric motor and the second rotating magnet of the magnetic pump both on the first mounting position on the isolation hood, and the inductive power generation assembly as well as the first rotating magnet and the pump body of the magnetic pump on the second mounting position of the isolation hood;

driving the electric motor to rotate the second rotating magnet, enabling the second rotating magnet to drive the first rotating magnet to rotate synchronously with the second rotating magnet by means of a magnetic force, such that the power generation induction coil generates power by cutting magnetic field lines of the first rotating magnet or of the second rotating magnet.

10. The water pumping device according to claim 8, wherein the second rotating magnet is coupled to a spindle of the electric motor.

* * * * *